US006826848B1

(12) United States Patent
Delaney et al.

(10) Patent No.: US 6,826,848 B1
(45) Date of Patent: Dec. 7, 2004

(54) APPARATUS FOR DRYING NAILS

(76) Inventors: Diane E. Delaney, 2408 Rte. 32, New Windsor, NY (US) 12553; Cornelia A. Arndt, P.O. Box 24, Pine Bush, NY (US) 12566

( * ) Notice: Subject to any disclaimer, the term of this patent is extended or adjusted under 35 U.S.C. 154(b) by 0 days.

(21) Appl. No.: 10/763,624

(22) Filed: Jan. 22, 2004

Related U.S. Application Data

(62) Division of application No. 10/462,504, filed on Jun. 16, 2003.

(51) Int. Cl.[7] ..... F26B 19/00

(52) U.S. Cl. ..... 34/90; 34/202; 34/62; 34/66

(58) Field of Search ..... 34/202, 426, 565, 34/62, 66, 90; D28/54.1, 58

(56) References Cited

U.S. PATENT DOCUMENTS

| | | | | |
|---|---|---|---|---|
| 2,184,858 A | | 12/1939 | Goodman | |
| 2,262,274 A | | 11/1941 | Fingerlin | |
| 2,389,822 A | | 11/1945 | Simmons | |
| 2,734,282 A | | 2/1956 | Nemeth | |
| 3,287,824 A | | 11/1966 | Selditz | |
| 3,864,847 A | | 2/1975 | Friedman et al. | |
| 4,193,209 A | | 3/1980 | Lovison et al. | |
| 4,255,871 A | | 3/1981 | Sigman | |
| 4,464,906 A | | 8/1984 | Outlaw | |
| D286,211 S | | 10/1986 | Zinbarg | |
| D286,926 S | | 11/1986 | Billings | |
| D292,625 S | | 11/1987 | Fung | |
| 4,754,769 A | | 7/1988 | Flynn | |
| D299,559 S | | 1/1989 | Wong | |
| D302,744 S | | 8/1989 | Flynn | |
| 5,084,984 A | | 2/1992 | Duchoud et al. | |
| 5,130,551 A | * | 7/1992 | Nafziger et al. | 250/492.1 |
| 5,249,367 A | * | 10/1993 | Nafziger et al. | 34/275 |
| 5,280,679 A | | 1/1994 | Edelman | |
| 5,351,417 A | | 10/1994 | Rubin | |
| 5,459,944 A | * | 10/1995 | Tatsutani et al. | 34/202 |
| 5,515,621 A | * | 5/1996 | Bloom | 34/275 |
| 5,568,691 A | * | 10/1996 | Rubin | 34/98 |
| 5,873,467 A | | 2/1999 | Willhite et al. | |
| 6,047,485 A | | 4/2000 | Madyun | |
| D451,247 S | | 11/2001 | Khalaj | |
| D453,858 S | | 2/2002 | Tsai | |
| D456,951 S | | 5/2002 | Christianson | |
| 6,405,387 B1 | * | 6/2002 | Barnes | 4/541.2 |

* cited by examiner

*Primary Examiner*—Ira S. Lazarus
*Assistant Examiner*—Kathryn S. O'Malley

(57) ABSTRACT

A method and apparatus for completely drying polished nails without any smudging or nicking. The method utilizes first warm air and then very cold air preferably followed by a brief return to warm air. The apparatus for performing the method includes a temperature controller for setting the temperature and timers for controlling the duration of each heating and cooling period. By means of an air heater and a cooler connected to a temperature controller, heats and cools the air which is forced upon the nails by a motor and fan.

7 Claims, 4 Drawing Sheets

APPARATUS FOR DRYING NAILS

RELATED APPLICATIONS

This Application is a Divisional Application of application Ser. No. 10/462,504 filed Jun. 16, 2003 entitled A Method and Apparatus for Drying Nails.

BACKGROUND OF THE INVENTION

1. Field of the Invention

The present invention relates generally to nail drying. More specifically this invention relates to an apparatus and a method for completely drying nail polish using both warm and very cold air, 2. Description of the Prior Art In nail and beauty salons, one of the substantial sources of income is manicures and pedicures, i.e. the cleaning, toning and polishing of the fingernails and toenails. One of the problems inherent in the process is that clients have limited time after the nails are polished. The client normally waits at the salon for about fifteen to twenty minutes hoping to dry her nails at room temperature. However, the nails are not completely dry after that time frame. Invariably, the customer nicks or smudges the nails after leaving the salon. As a result, the damaged nails must be redone and still more time is spent waiting for the nail polish to dry. Many manicurists do not utilize machines to assist in drying fingernails or toenails after a polish is applied. However, nail drying machines are well known in the art. Such devices fail to reduce the drying time for nails to an appreciable extent.

Existing apparatus to dry nails can be broken down into three categories. Category one includes nail polish dryers that utilize heat. Examples of such nail polish dryers are as follows:

| PATENTEE | U.S. Pat. No. |
|---|---|
| GOODMAN | 2,184,858 |
| FINGERLIN | 2,262,274 |
| NEMETH | 2,734,282 |
| SELDITZ | 3,287,824 |
| FRIEDMAN ET AL | 3,864,847 |
| SIGMAN | 4,255,871 |

Category two uses forced ambient air to dry nails. However, in this group the ambient air is not heated or cooled by external means. The Simmons Patent, U.S. Pat. No. 2,389,822 shows a nail polish dryer where separate finger receiving passages are provided for each finger and the thumb. Air is directed past the tips of the fingers and is vented from the device by outlets. U.S. Pat. No. 4,193,209 is a nail dryer that equips the device with a hand rest to aid in both the application of the polish and that is positioned such that air is driven by a fan and deflected by the vents which speeds the drying of the polish. The Duchoud Patent, U.S. Pat. No. 5,084,984 is a clamshell type of housing where the device is opened by tilting the cover back on its hinges and contact strips are brought together providing power to a fan that drives air through the drying zone. Opening the cover activates the fan which supplies air to dry the nails.

Category three includes patents which use cooled air to dry nails. The Outlaw Patent, U.S. Pat. No. 4,464,906, uses air that is cooled below ambient temperatures before it is directed onto the fingernails. In this patent, the temperature discussed is between forty-five and sixty-five degrees Fahrenheit.

In general, the main problem with conventional nail polish drying machines is that they don't dry or set the nails completely. This is evidenced in the Edelman Patent, U.S. Pat. No. 5,280,679 whereby the inventor claims that she can dry nails to a "substantial" state. Drying to a "substantial state" means that the nails are not completely dried and therefore will smudge or nick. Also, the prior art states that optionally it would be possible to further augment the speed of the drying process by utilizing a chemical drying agent. This further highlights the major weakness of the prior art machines because if such machines worked, there would be no need for additional chemical drying agents.

It is apparent that there is a clear need for a method of drying nails and an apparatus to perform that method which results in a hardened finish

OBJECTS OF THE INVENTION

The objects of this invention are as follows:

To provide for quick drying of nail polish;

To provide a method and apparatus for drying nails that produces a completely hardened nail polish that will not smudge or nick;

To sanitize the apparatus after each use;

To provide a nail dryer that will dry both hands or both feet at one time;

To provide a nail dryer that will dry nails in a brief time period of no more than six minutes;

To provide a nail dryer that is compact and easy to use and completely automatic;

To provided a nail dryer that will completely dry nails to total dryness;

To provide an apparatus for drying nails which is inexpensive and dependable;

To provide for quick and complete drying of nail polish by providing a warm and very cold temperature in the area proximate to the polished nail within a time of less than seven minutes.

These and other objects of the present invention will become readily apparent upon further review of the following specifications and drawings;

SUMMARY OF THE INVENTION

A method is provided for drying nail polish that has been applied to the nails of an extremity. First, warm air is directed on the nails and hen followed by very cold air.

An apparatus is also provided to perform the above method. The apparatus which works with a power supply includes a housing with an opening in it into which an extremity is placed. A means for heating and cooling air including a means for directing the means for heating and cooling air to blow first warm air and then very cold air on the extremities. Preferably, a sanitizing means for sanitizing the enclosure and a means for activating the sanitizing means are also provided.

BRIEF DESCRIPTION OF THE NUMERALS

| NUMERAL | DESCRIPTION |
|---|---|
| 11 | EXTREMITY |
| 12 | FLOW OF AIR |
| 13 | HOUSING |
| 14 | MOTOR AND FAN |
| 15 | TEMPERATURE SETTING UNIT |
| 17 | TEMPERATURE CONTROLLER |
| 19 | BASE |
| 20 | TOP |
| 21 | TWO SIDE PANELS |
| 23 | FRONT AREA |
| 25 | BACK PANEL |
| 27 | FRONT PANEL |
| 29 | OPENING |
| 31 | MOTION SENSOR |
| 33 | ENCLOSURE |
| 35 | POWER SWITCH |
| 37 | SANITIZING BULB |
| 39 | POWER SUPPLY |
| 41 | REST PLATE |
| 45 | AIR HEATER AND COOLER |
| 51 | HOT AND COLD TIMERS |
| 55 | TEMPERATURE SENSOR |
| 57 | LOGIC CIRCUIT |
| 59 | BULB TIMER |

DESCRIPTION OF THE PREFERRED EMBODIMENT

The invention provides an improved method and an apparatus for completely drying the polish applied to nails. As used herein, the term polish encompasses different liquids normally applied to the nails by a manicurist. Each of these materials is in liquid form when applied to the nails and the nail is therefore "wet" until the liquid has dried and hardened to the extent that it can no longer be removed by merely touching the nail against an object. It will be understood that the phrase drying the nails "as used herein means completely drying the polish on the nails. Additionally, it will be understood that the phrase completely dry" as used herein, means with no incidence of any wetness to permit smudging or nicking of the polish.

The present invention involves the use of warm and very cold air to dry the polish on the nails. It has been found that the combined sequential use of warm and very cold air dries polish more quickly than room temperature air or either just warm air or very cold air.

Figure 1:
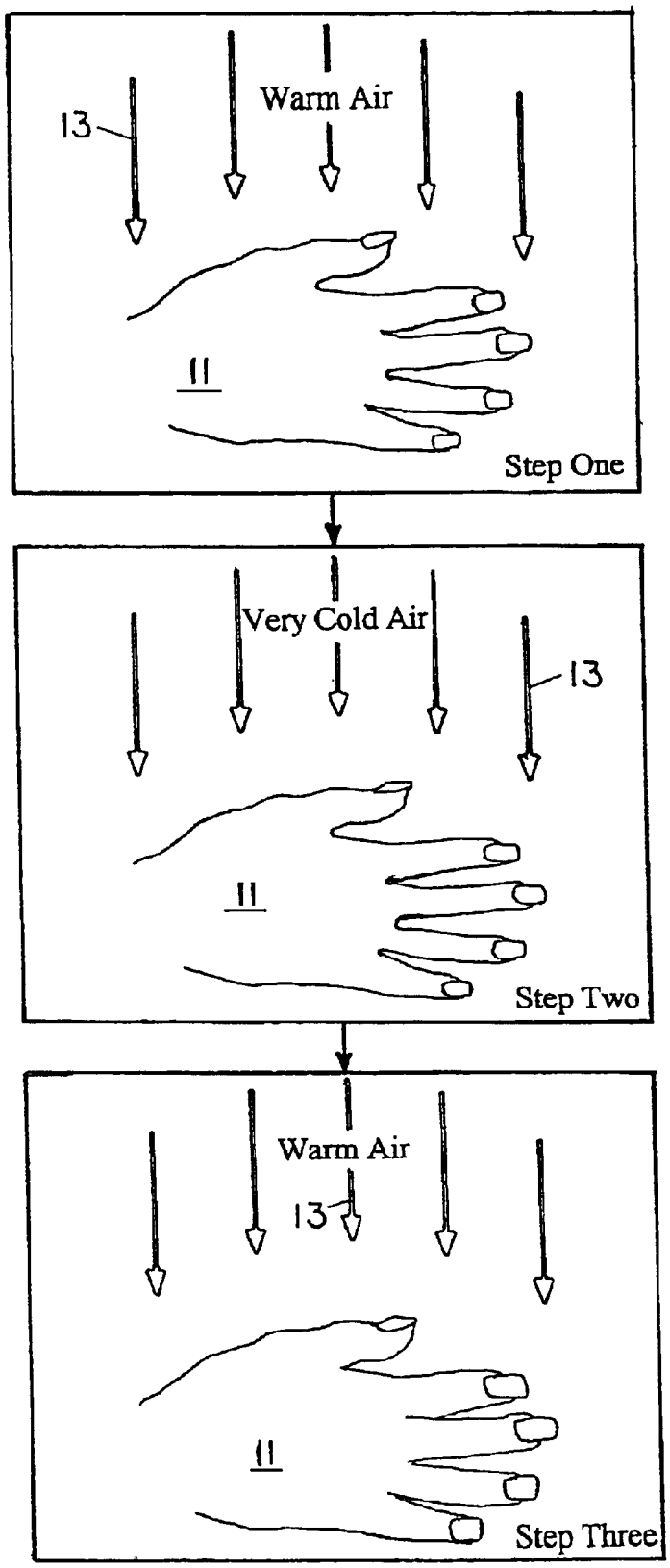
FIG. 1 is a schematic view showing the steps of the method in accordance with this invention.

Referring to FIG. 1, the three steps of the method are shown. An extremity 11, which may be either hands or feet having freshly polished nails, is placed in a flow of air 12.

In Step one, warm air having a temperature range of eighty-three to eighty-five degrees Fahrenheit, is blown on the newly polished nails. The preferred temperature is eighty-five degrees Fahrenheit. The warm air is applied for approximately four minutes.

Then, as shown is Step Two of FIG. 1, the air is cooled to a range of thirty-four to thirty-five degrees Fahrenheit and blown on the nails for two minutes.

At the conclusion of Step Two of FIG. 1, as shown in Step Three, the temperature of the air being blown into the nails is once again increased to the range of eight-three to eighty-five degrees Fahrenheit for a very brief period, namely approximately Fifteen seconds. Complete drying can be obtained without Step Three but comfort is obtained by Step Three.

Figure 2:
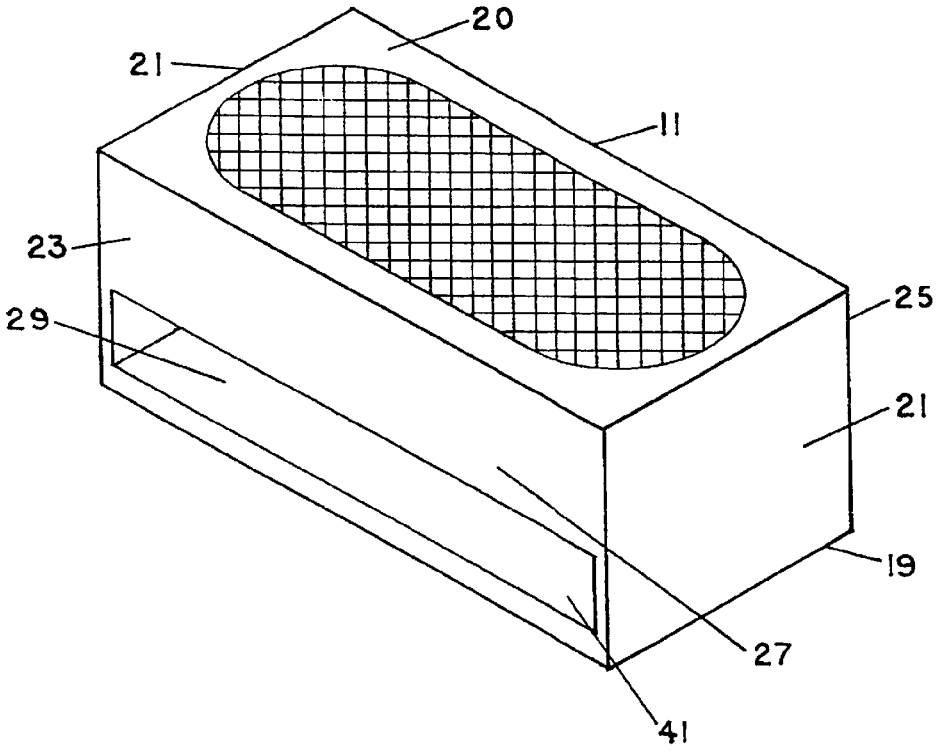
FIG. 2 is a perspective view of the outside enclosure of the apparatus in accordance with this invention.

The above described method is provided by an apparatus shown in FIG. 2. This apparatus is suitable for use at one's home or in a manicurist's salon directing warm and very cold air, in accordance with the described method, onto newly polished nails.

In FIG. 2, the apparatus is shown for producing the previously described method. A housing 13 is provided in which a motor and fan 14, a temperature setting unit 15 and a temperature controller 17. The housing 13 includes a base 19, a top 20, two side panels 21, a front area 23, a back panel 25 and a front panel 27. An opening 29 is located in the front area 23 of the housing 13 for insertion of extremities, namely, hands or feet, as may be desired. The nail dryer is designed for the insertion of both extremities 11, whether two hands or two feet, at the same time.

The opening 29 is where the extremities 11 are inserted to obtain nail drying. A motion sensor 31 is located in an enclosure 33. The opening 29 provides access to the enclosure 33 within the housing 13. A power switch 35 turns the nail dryer on and off. A sanitizing bulb 37 is also located in the enclosure 33. The motion sensor 31, providing the power switch 35 is on, upon an extremity 11 or pair of extremities 11 being placed into the enclosure 33 activates the commencement of the nail drying process. The nail dryer, must of course, be connected to a power supply 39.

A rest plate 41 onto which the extremities 11 are placed within the enclosure 33 is located slightly higher than the base 19 of the housing 13. The rest plate 41 preferably has a non-porous, skid free surface. The front panel 27 drops down to a level approximately four inches above the rest plate when an extremity is placed on the rest plate 41. The front panel 27 retracts at the end of the drying cycle and is activated by the motion sensor 31 located within the housing 13 which would sense loss of air movement. The front panel 27 must retract before the extremities are removed so there will be no chance of hitting the nails on the front panel 27. Once the front panel 27 has retracted, free movement is provided to retract the extremities.

The power supply 39 is connected to the motor and fan 14 and an air heater and cooler 45 and to the temperature controller 17. There is no need for further external control adjustment means because the nail dryer operates through the temperature controller 17 and warm and very cold timers 51.

Figure 3:
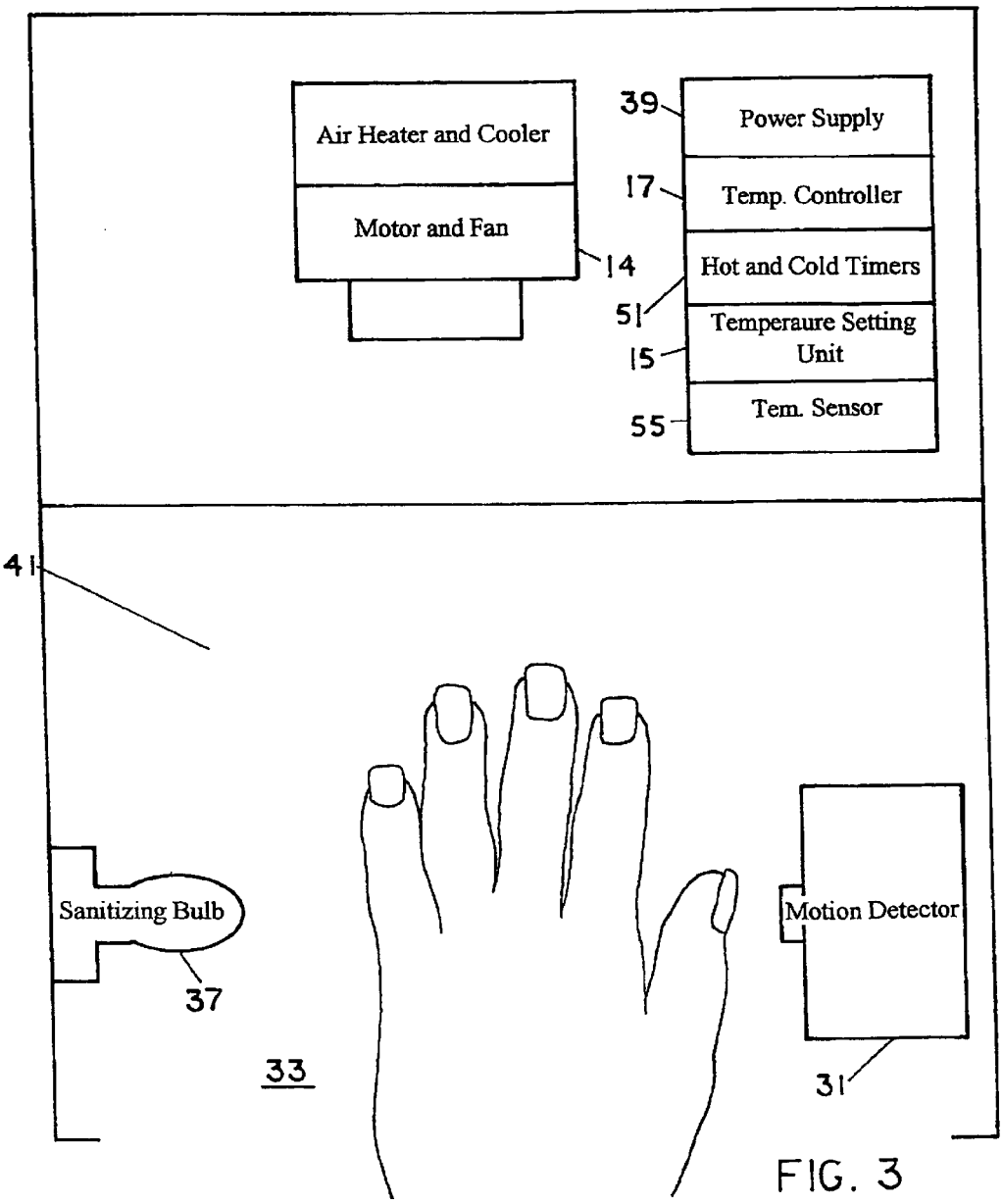
FIG. 3 is an internal top view of the placement of the components of this invention and showing a hand within the apparatus.

FIG. 3 shows a top view of the lower portion of the enclosure 33. An extremity 11 with nails requiring drying of polish is shown inserted into the opening 29 and placed upon the rest plate 41. The motion sensor 31 detects the presence of the extremity 11 which has been inserted into the opening 29. Toward the back panel 25 of the housing 11, an air heater and cooler 45 is located. The air heater and cooler 45 contains the motor and fan 14. The air forced by the motor and fan 14 which passes through the air heater and cooler 45 is directed at the extremities 11 on the rest plate 41.

Also located with the air heater and cooler 45 are the temperature controller 17, hot and cold timers 51, temperature setting unit 53 for both hot and cold temperatures, and a temperature sensor 55.[1] The enclosure 33 of the nail dryer also contains the sanitizing bulb 37. This sanitizing bulb 37 turns on for a preset period of time when the motion sensor 31 detects that the extremities 49 have been removed from the nail dryer.

[1]Thermo-electric modules, including Temperature Controllers and related equipment for producing alternating warm and very cold air flows are commercially available from TE Technology, Inc., 1590 Kenine Drive, Ttraverse City, Mich. 49686-8257.

Figure 4:
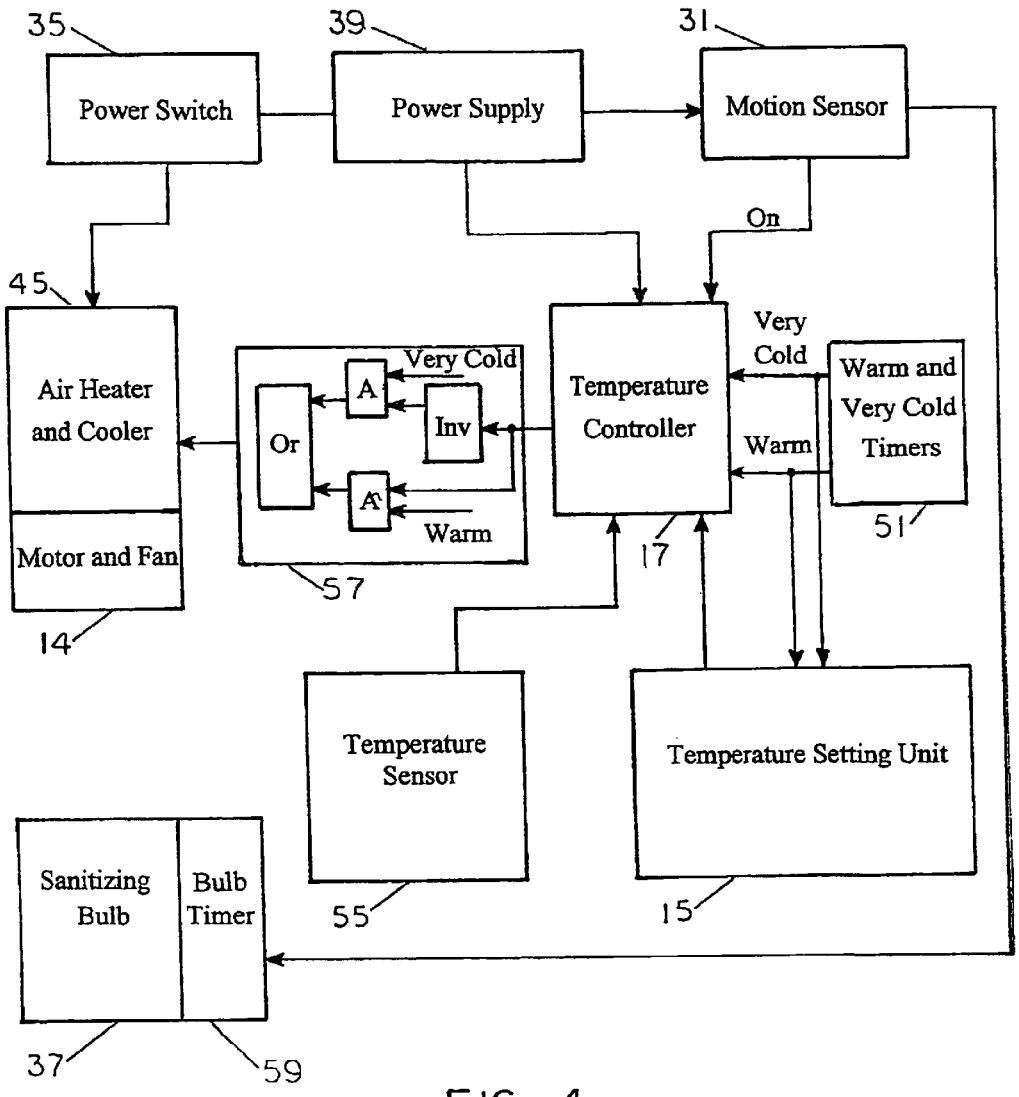
FIG. 4 is a block diagram of the electrical components of the apparatus.

FIG. 4 shows a block diagram of the electrical components of the nail dryer. As previously stated, the motion sensor 31 detects the insertion of an extremity 11 into the nail dryer. When this insertion occurs, the motion sensor 31 generates an "On" signal, which goes to the temperature controller 17 to indicate that the warm-very cold-warm drying cycle should begin. The temperature controller 17 then begins generating the warm cycle, which needs to be active for four minutes. The warm and very cold timers 51 control the length of this period, which as the method states, is four minutes. The temperature controller 17 sends an output of a specified polarity to the air heater and cooler 45 during the warm period. The proper polarity for triggering a warm air output from the air heater and cooler 45 is established by a logic unit 57. After the initial warm period, the temperature controller 17 shifts into the very cold period, which extends for two minutes as directed by the hot and cold timers 51. The proper polarity for triggering a very cold air output from the air heater and cooler 51 is established by the logic unit 57. The temperature controller 17 provides an output that is inverted for a very cold cycle. The temperature controller 17 gets its warm and very cold temperatures for the warm and very cold temperatures periods from the temperature setting unit 15.

The temperature sensor 55 measures the temperature of the ambient air inside the nail dryer to regulate and maintain that ambient temperature at a stable eighty-five degrees Fahrenheit for warm periods and thirty-five degrees Fahrenheit for very cold periods. The power supply 39 supplies the required electricity for all of the electrical components shown in FIG. 4.

FIG. 4 also shows the sanitizing bulb 37, which is an ultraviolet germicidal light bulb and is turned on by the motion sensor 31 when the extremity 49 is removed from the enclosure. The sanitizing bulb 37 stays on for a period of time dictated by a bulb timer 59.

The advantages of this invention are several. It is the primary advantage of the present invention to have a combination of warm and very cold air to enable polished nails to dry completely, avoiding the need to immediately repeat the application of nail polish. Another advantage is to provide a machine that will dry nails more quickly than prior art machines. The provision for a sanitized rest plate for each client is most advantageous. The nail dryer provides a completely automated approach for the user. With this invention, time is saved for the nail salon owner, as the whole drying and sanitizing process is automatic, so operators do not have to oversee the individual client nail drying process.

It is to be understood that the drawings and description matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What is claimed is:

1. An apparatus for drying nails on extremities for use with a power supply, said apparatus comprising:

a housing having an opening in it into which an extremity is placed;

an enclosure inside the housing connected to the opening;

means for heating and cooling air including a means for first blowing warm and then blowing very cold air from the means for heating and cooling air into the enclosure;

A timer to set a time period of approximately four minutes for blowing warm air and to set a time period of approximately two minutes for blowing very cold air, Means to set the temperature of the warm air at approximately eighty five degrees Fahrenheit and the temperature of the very cold air at approximately thirty five degrees Fahrenheit and means for activating the means for heating and cooling and the time and the means to set the temperature of the warm air and the very cold air.

2. An apparatus for drying nails according to claim 1 further including a sanitizing means for sanitizing the enclosure and a means for activating the sanitizing means.

3. An apparatus for drying nails according to claim 1, wherein the means for actuating the means for heating and cooling air further includes:

a temperature controller for controlling the hot temperature and the cold temperature; and a motion sensor located in the enclosure, the temperature controller being actuated by the motion sensor.

4. An apparatus for drying nails according to claim 1 wherein the means for actuating the means for heating and cooling further includes:

a temperature controller for controlling the hot temperature and the cold temperature;

a motion sensor located in the enclosure, the temperature controller being actuated by the motion sensor;

means for connecting the power supply to the temperature controller and the motion sensor;

a temperature sensor to determine the temperature of the air blown into the enclosure by the motor and fan, the temperature sensor being connected to the temperature controller; and means for connecting the temperature controller to the air heater and cooler.

5. An apparatus to dry nails on at least one extremity for use with a power supply, said apparatus comprising:

a housing having a base, two side panels, a back panel, a top and a front area, the front area including an opening;

an enclosure located within the housing, the enclosure being connected to the opening in the front area;

an air heater and cooler including a motor and fan for blowing both warm and very cold air into th enclosure;

a temperature controller for controlling the hot temperature and the cold temperature;

a motion sensor located in the enclosure, the temperature controller being actuated by the motion sensor;

means for connecting the power supply to the temperature controller and the motion sensor;

a temperature setting unit connected to the temperature controller to set the hot temperature and the cold temperature of the temperature controller;

a timing means connected to the temperature controller for controlling the duration of the hot temperature and the cold temperature;

a temperature sensor to determine the temperature of the air blown into the enclosure by the motor and fan, the temperature being connected to the temperature controller; and a means for connecting the temperature controller to the air heater and cooler.

6. An apparatus according to claim 5 further including:

a sanitizing means for sanitizing the enclosure; and a sanitizing timer connected to the sanitizing means, the sanitizing timer being connected to the motion sensor.

7. An apparatus according to claim 5 further including:

a sanitizing means for sanitizing the enclosure;

a sanitizing timer connected to the sanitizing means, the sanitizing timer being connected to the motion sensor; and a power switch for activating the power supply.

* * * * *